US005964624A

United States Patent [19]

Pernelle

[11] Patent Number: 5,964,624

[45] Date of Patent: Oct. 12, 1999

[54] ELECTRICAL CONNECTION DEVICE HAVING IMPROVED CONTACT RELIABILITY

[75] Inventor: Jean Alexis Pernelle, Luxembourg, Luxembourg

[73] Assignee: Air LB International S.A., Luxembourg, Luxembourg

[21] Appl. No.: 09/018,779

[22] Filed: Feb. 4, 1998

[30] Foreign Application Priority Data

Feb. 6, 1997 [FR] France ..... 97 01359

[51] Int. Cl.[6] ..... H01R 9/22

[52] U.S. Cl. ..... 439/721; 439/357

[58] Field of Search ..... 439/721, 723, 439/724, 357, 358, 595

[56] References Cited

U.S. PATENT DOCUMENTS

| | | | |
|---|---|---|---|
| 3,560,911 | 2/1971 | Zimmerman et al. | 439/723 |
| 4,653,842 | 3/1987 | Kirma | 439/712 |
| 4,854,899 | 8/1989 | Matthews | 439/724 |
| 5,374,202 | 12/1994 | Anderson | 439/724 |
| 5,391,096 | 2/1995 | Chiron et al. . | |
| 5,540,602 | 7/1996 | Bell | 439/721 |
| 5,674,088 | 10/1997 | Roche et al. | 439/357 |
| 5,769,650 | 6/1998 | Aoyama et al. | 439/357 |

FOREIGN PATENT DOCUMENTS

| | | |
|---|---|---|
| 0576361 | 12/1993 | European Pat. Off. . |
| 0576365A1 | 12/1993 | European Pat. Off. . |
| 2510315 | 1/1983 | France . |
| 2575612 | 7/1986 | France . |

*Primary Examiner*—Steven L. Stephan
*Assistant Examiner*—Hae Moon Hyeon
*Attorney, Agent, or Firm*—Lawrence G. Fridman

[57] ABSTRACT

Electrical connection device comprising an insulating casing which contains contacts 10 into which terminals 18, fixed to the ends of the conductors 19 to be connected, are plugged.

The casing is divided into two parts 1, 2 which include means 21, 22, 23, 24, 25, 26, 43, 44 for holding the two parts 1, 2, one fitted into the other, in a first position in which the terminals 18 are immobilized (snap-in means 27), without being plugged into the contacts 10, and in a second position in which the terminals 18 are plugged into the contacts 10 and the snap-in means 27 are locked (locking means 11).

17 Claims, 6 Drawing Sheets

ELECTRICAL CONNECTION DEVICE HAVING IMPROVED CONTACT RELIABILITY

The present invention relates to an electrical connection device comprising an insulating casing which contains contact elements, parallel cavities emerging on one and the same side of the casing for the insertion, from the said side, into the said cavities, of contact terminals which are fixed to the ends of the conductors to be connected and include retention means, for the purpose of plugging these terminals into the said contact elements, and means which engage with the said retention means of the contact terminals in order to retain, in the casing, the contact terminals plugged into the contact elements.

Such an electrical connection device may be both in the form of a connection module, in which the contact elements are shunts intended to establish connection between several contact terminals, and in the form of a connector comprising two complimentary parts, one having male contacts and the other having female contacts, in which case the contact elements consist of female contacts on one connector part and male contacts on the other connector part.

For more details regarding the general structure of such connection modules and of such connectors, as well as their contacts, reference may be made, for example, to documents FR-A-2,115,556 and FR-A-2,575,612.

The connection devices of this type are used, for example, for establishing connections during wiring in fields such as aeronautics. This wiring is generally carried out by preparing groups or bundles of conductors called "wiring harnesses" which are prefabricated and already provided with their connection devices. A first electrical continuity check is generally made at the end of manufacture of the harnesses and a second continuity check is made after mounting the harnesses in the aircraft.

The purpose of these electrical continuity checks is, on the one hand, to confirm that the wiring produced actually corresponds to the diagram provided and, on the other hand, to ensure that the contacts are properly established, that is to say that the contact terminals fixed to the ends of the conductors to be connected are correctly plugged into the contact elements provided in the insulating casing of the connection devices.

Despite all these checks, it proves to be the case that there still always remain bad contacts which are essentially due to contact terminals not fully plugged-in, giving rise, in operation, owing to the effect of vibrations, to microbreaks which appear in the form of random faults which are extremely difficult to locate.

This is the reason why the object of the present invention is to provide an electrical connection device designed to ensure, by means of a particular structure of the device and by means of a particular method of plugging the contact terminals into the contact elements, enhanced reliability, on the one hand, when inserting the contact terminals into the connection device and, on the other hand, when establishing contact between the terminals thus inserted and the contact elements of the connection device, thus providing markedly improved contact reliability.

The electrical connection device according to the invention comprises an insulating casing which contains contact elements, parallel cavities emerging on one and the same side of the casing for the insertion, from the said side, into the said cavities, of contact terminals which are fixed to the ends of the conductors to be connected and include means of retention, and for plugging these terminals into the said contact elements, and means which engage with the said retention means in order to retain, in the casing, the contact terminals plugged into the contact elements. The casing is divided, transversely to the axes of the cavities, into two casing parts which can be fitted together and which, after being fitted together, can move, one with respect to the other, parallel to the axes of the cavities between a first position and a second position. The casing comprises means for holding the two casing parts in each of the said two positions. A first casing part includes, at the site of each cavity, snap-in means which, in the said first position of the casing parts, engage with the said retention means of the contact terminals during insertion of the latter into the cavities, so as to immobilize the contact terminals due to the snap-in effect in a well-defined position. The second casing part bears the contact elements and includes locking means, in such a way that, in the said first position, the said terminals are not plugged into the contact elements and the locking means do not engage with the snap-in means and that, in the said second position, the contact terminals are plugged into the contact elements and the locking means engage with the snap-in means, locking the latter onto the retention means of the contact terminals.

Thus, in order to plug the contact terminals into the connection device according to the invention, with the two casing parts being in the first position, the operator firstly inserts the contact terminals of the conductors into the cavities, until the contact terminals are snapped in, this snapping-in being clearly perceptible by the operator. When all the contact terminals are inserted and snapped into the connection device, the operator brings the two casing parts of the connection device into the second position, which means that all the snapped-in terminals are inserted into the contact elements and, simultaneously, the locking means lock the snap-in means onto the retention means of all the contact terminals, thus making it impossible to extract any contact terminal.

Preferably, the retention means on the contact terminals may consist, in a manner known per se, of an external annular collar projecting from the body of the terminals and the snap-in means comprise stop means engaging with that flank of the collar which is turned towards the direction of insertion of the terminals, in order to limit and define the depth of insertion of the terminals, and holding means which engage with the opposite flank of the collar in order to hold the terminal in the said position.

Preferably, the said holding means are designed so as, in the said first position of the two casing parts, to allow not only insertion of the terminals until they have been snapped in, simply by pushing them, but also extraction, and therefore snapping-out, of the terminals simply by pulling on them, without the use of a tool.

The snap-in means may advantageously comprise, for each cavity, at least two fingers distributed around the axis of the cavity, these fingers being resilient, preferably resilient in flexure, so that they move apart elastically during insertion of a contact terminal, for passage of the retention means of the latter.

If the collar of each contact terminal has, in a manner known per se, two flanks substantially perpendicular to the axis of the contact terminal, the fingers of the snap-in means advantageously extend in a cantilevered fashion substantially in the direction of insertion of the contact terminal and the stop means preferably comprise a rim substantially perpendicular to the length of the fingers, at the free end of the latter, while the holding means comprise, between the free end of each finger and its connection to the first casing part, an excrescence having two oblique flanks.

The snap-in means may advantageously be formed as a single piece with the first casing part.

The means for locking the snap-in means may preferably comprise, for each contact terminal, an annular element having such an internal diameter and such a position on the second casing part that the said element can fit onto the snap-in means, in the said second position, therefore preventing the contact terminal from being snapped out.

Preferably, the retention means of the terminals, the snap-in means and the locking means are arranged so that the locking means prevent the two casing parts from passing from the first position to the second position when the fingers of the snap-in means are moved apart by the retention collar of a terminal which is incompletely inserted, and therefore not snapped in, thus clearly indicating to the operator that a terminal has not been fully inserted.

Preferably, the means for holding the two casing parts in the two positions comprise snap-in means.

The connection device according to the invention can be used as a connection module comprising, in order to fix it to a support rail having a U-shaped profile, two opposed external shoulders which engage with internal rims of the flanges of the U-shaped profile of the support rail. In this case, the said shoulders are arranged on the first casing part so that the said shoulders can engage with the rims of the rail, in order to fix the module, only if the two parts of the casing are in the second position and that, when the module is fixed to the rail, the latter locks the two casing parts in the said second position.

If the connection device according to the invention is used as a connector comprising two connector parts, one part having male contacts and the other having female contacts, and comprising accessories such as cable ties fixed externally on at least one connector part, the external subdivision of the casing of this connector part passes via the region for fixing an accessory in such a way that the latter can be fixed only if the two casing parts are in the second position and that, when the accessory is fixed, it locks the two casing parts in the said second position.

An illustrative and non-limiting embodiment of a connection device according to the invention, in its application to a connection module, will be described below in more detail, with reference to the appended drawings; in the drawings.

Figure 1:
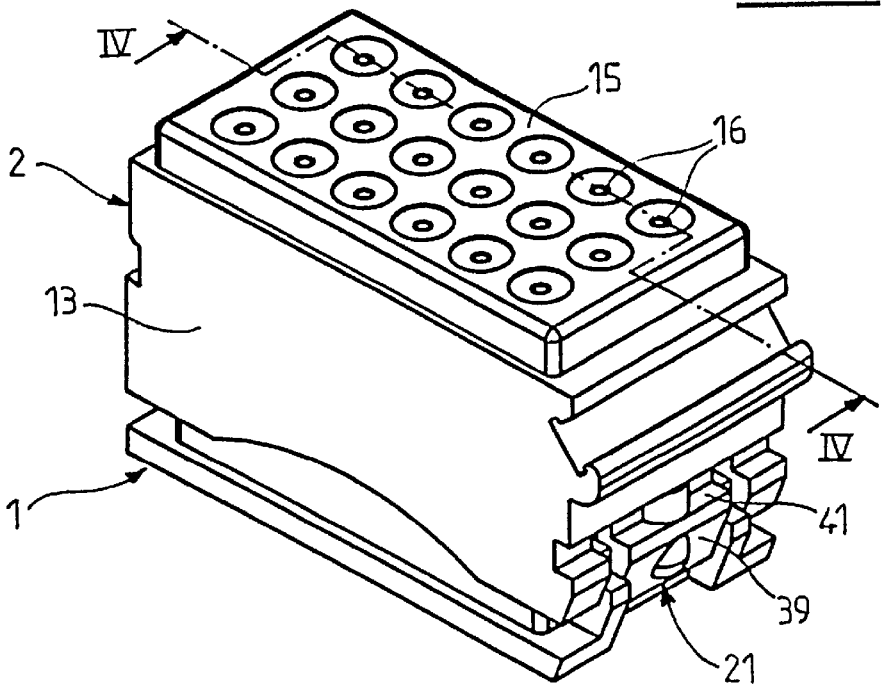
FIG. 1 is an external perspective view of the module according to the invention, the two casing parts of the module being in the first position

The electrical connection device as illustrated by the drawings is a connection module of the type comprising, in a manner known per se, an insulating casing which contains at least one shunt for the interconnection of several conductors which have, at their ends, contact terminals which are intended to be plugged into the module, from one and the same side of the latter, for the purpose of making contact with said shunt.

As may be seen in particular in FIGS. 1 to 5, the insulating casing of the module, of parallelopipedal general shape, is composed of two parts, namely a lower part 1 and an upper part 2, the lower part 1 being able to be fitted into the upper part 2.

The lower casing part 1 made of a rigid material has a closed base 3 from which four side walls 4, 5, 6, 7 and four transverse partitions 8 project upwards, these together defining six rectangular housings 9, open at the top, which are intended to receive six shunts 10 with two contacts each. An insulating insert 11 having three rows of six through-holes 12 is added and fixed, for example by welding, to the top of the lower casing part 3, after inserting the shunts 10 into the housings 9.

The upper casing part 2 comprises a body 13 made of a rigid material, delimited by two opposed long sides and two opposed short sides, through which two times five parallel cylindrical cavities 14 pass, and an upper sealing part 15 made of a flexible material having three times five through-holes 16 aligned with the cavities 14.

Figure 4:
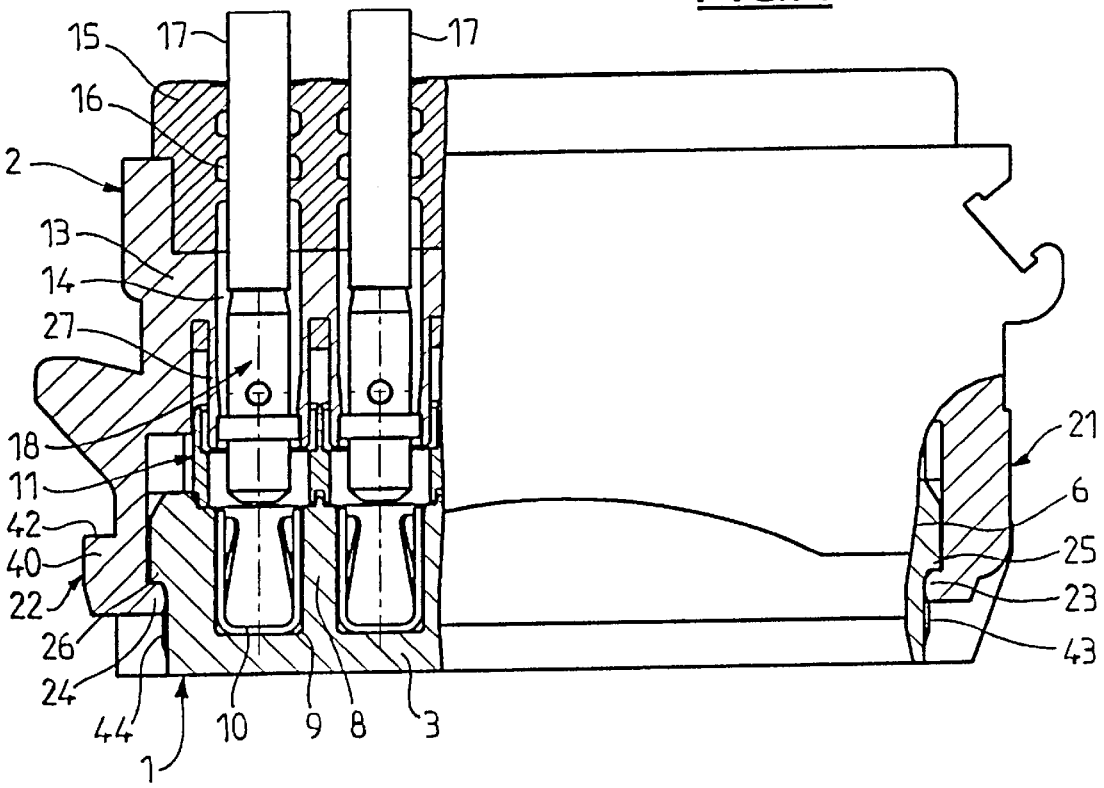
FIG. 4 is a partial section on IV—IV of FIG. 1, with the ends of the conductors fixed to the inserted terminals.
Figure 5:
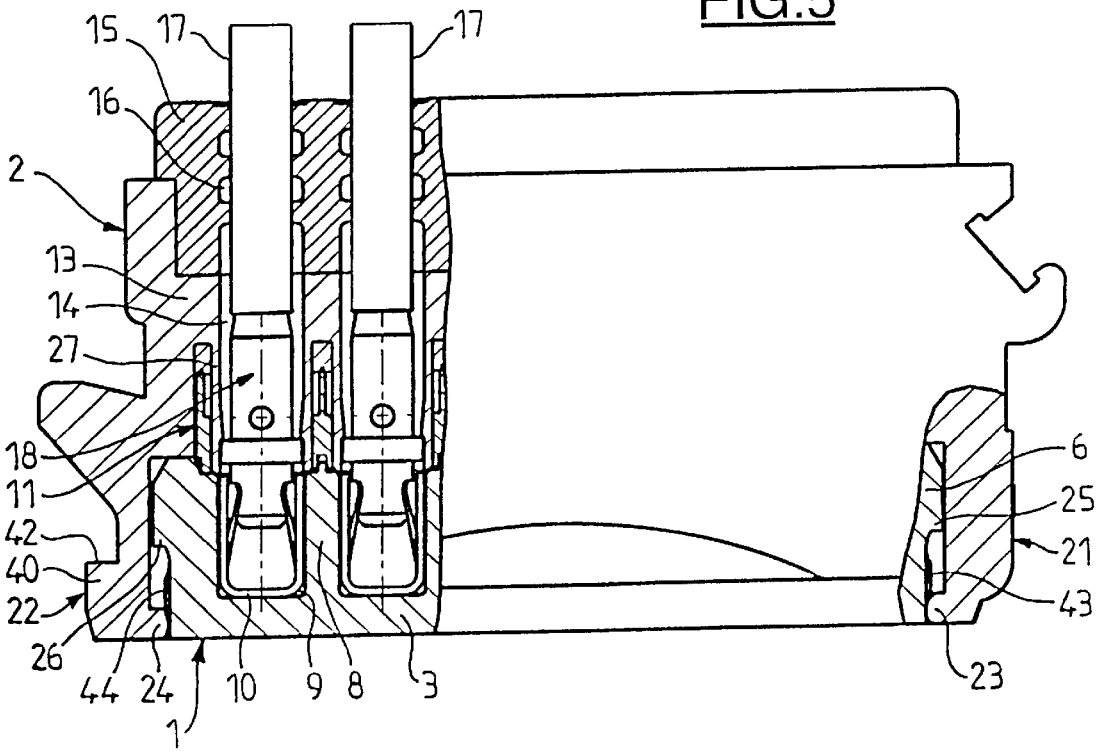
FIG. 5 is a corresponding partial section on V—V of FIG. 2.

As shown in FIGS. 4 and 5, the electrical conductors 17, intended to be interconnected in the connection module, by means of the shunts 10, each have a contact terminal 18 at their end, the terminal being fixed, for example, by soldering. Each contact terminal 18 has, in a manner known per se, as shown in more detail in FIGS. 6 and 7, a substantially cylindrical body with one end on a portion 19*a* having a blind hole for inserting and soldering the stripped end of a conductor 17 and, between its two ends, an external annular collar 20 whose two flanks are substantially perpendicular to the axis of the terminal 18. That part 19*b* of the body of the terminal 18 lying between the said collar 20 and the free end of the terminal 18 fixed to the conductor 17 constitutes the connection part intended to establish electrical contact with a shunt 10.

It should be pointed out that the upper casing part 2 has, in the middle part of the width of each of its two opposed short sides, a resilient tab 21, 22 having an internal rim 23, 24 (see FIGS. 4 and 5) which, when locking the lower casing part 1 in the upper casing part 2, engages, in a manner which will be described in more detail later, with external shoulders 25, 26 provided on the side walls 6 and 7 of the lower casing part 1 in order to keep the two casing parts joined together.

Figure 8:
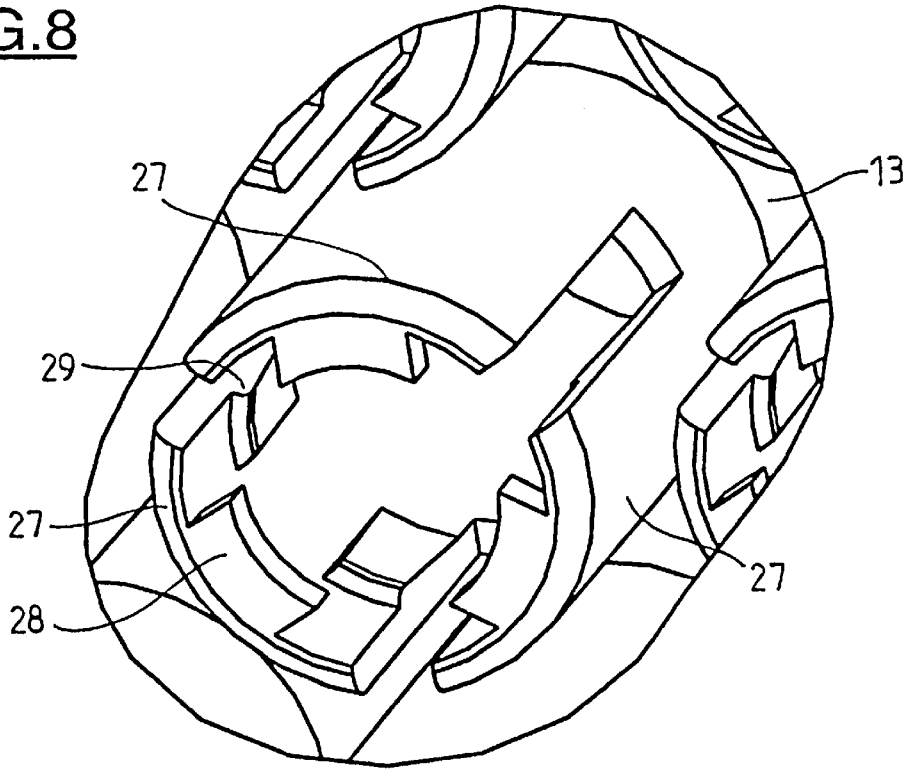
FIG. 8 is a perspective view on a larger scale of the snap-in means for a contact terminal.
Figure 9:
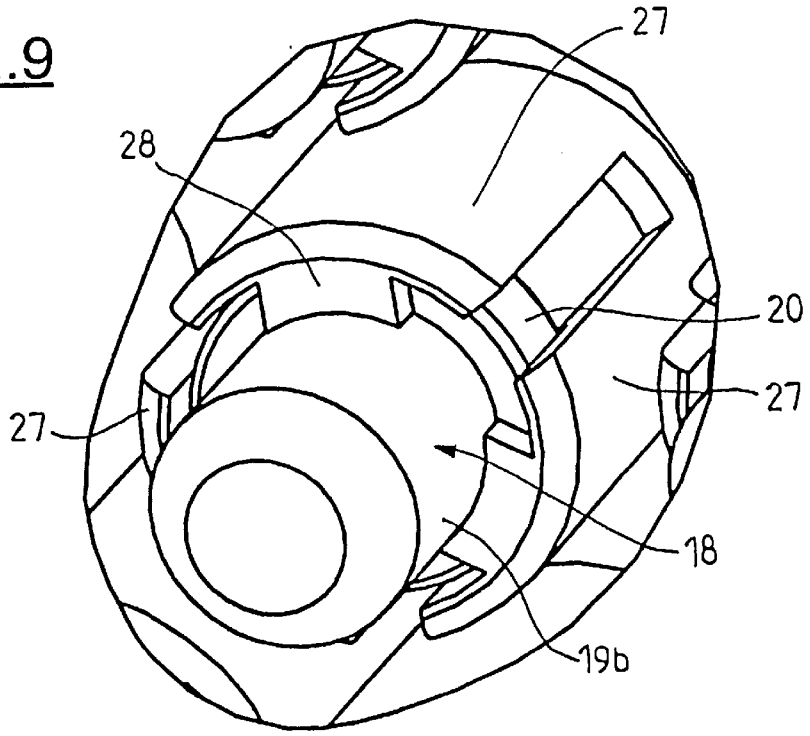
FIG. 9 is a view corresponding to that of FIG. 8, showing a contact terminal inserted into the snap-in means.

The body 13 of the upper casing part 2 moreover includes, in the downward extension of each cavity 14, three snap-in fingers 27 which extend parallel to the axis of the cavity 14, being arranged around the said axis in the manner of petals, as may be seen particularly in FIGS. 8 and 9. Each finger 27 has, at its free end, an internal stop rim 28 which extends towards the opposite finger and, between the said rim and the end where it joins the body 13, an excrescence 29, having a triangular profile, the distance between the rim 28 and the excrescence 29 being substantially equal to the (axial) width of the collar 20 of the terminal 18.

Figure 6:
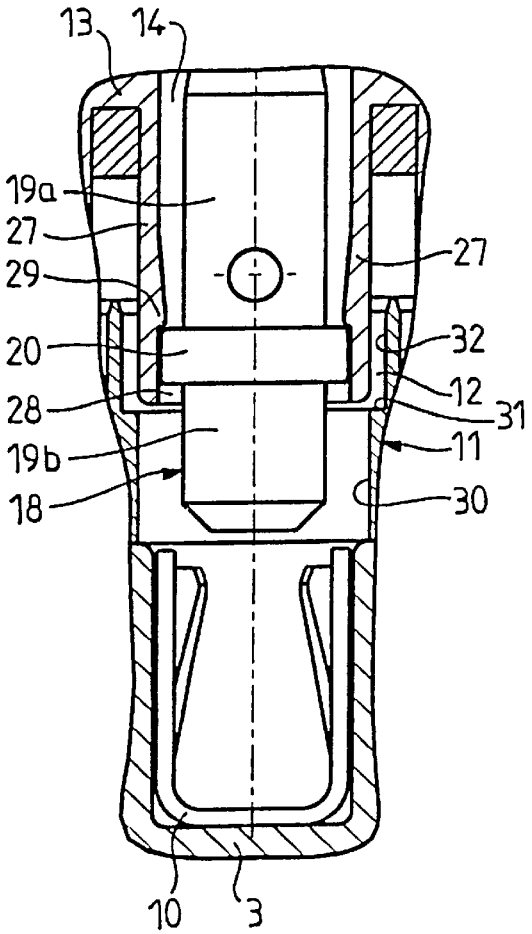
FIG. 6 is a partial section on a larger scale of FIG. 4, showing an inserted and snapped-in contact terminal, before it is plugged into the contact element.
Figure 7:
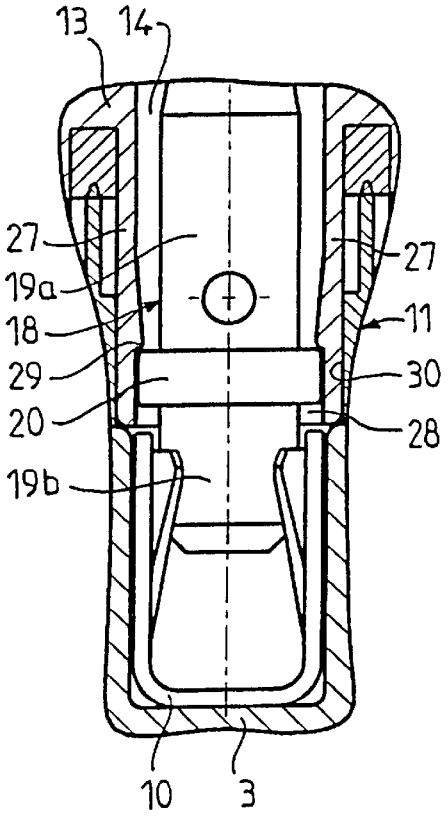
FIG. 7 is a partial section on a larger scale of FIG. 5, showing a contact terminal plugged into to the contact element, the snap-in means being locked.

Moreover, as may be particularly seen in FIGS. 6 and 7, each through-hole 12 in the insert 11 fixed to the lower casing part 1 comprises a lower portion 30 whose diameter is substantially equal to the external diameter of the petal formed by the three unsplayed snap-in fingers 27, which lower portion is joined, at the top, by a step 31, to an upper portion 32 whose greatest diameter is at least equal to the external diameter that the petal of fingers 27 can assume when the fingers 27 are splayed out to the maximum extent at the moment when the collar 20 of a contact terminal 18 is passing the site of the excrescences 29 of the fingers 27, during insertion or removal of the contact terminal 18, as described in more detail below.

Figure 10:
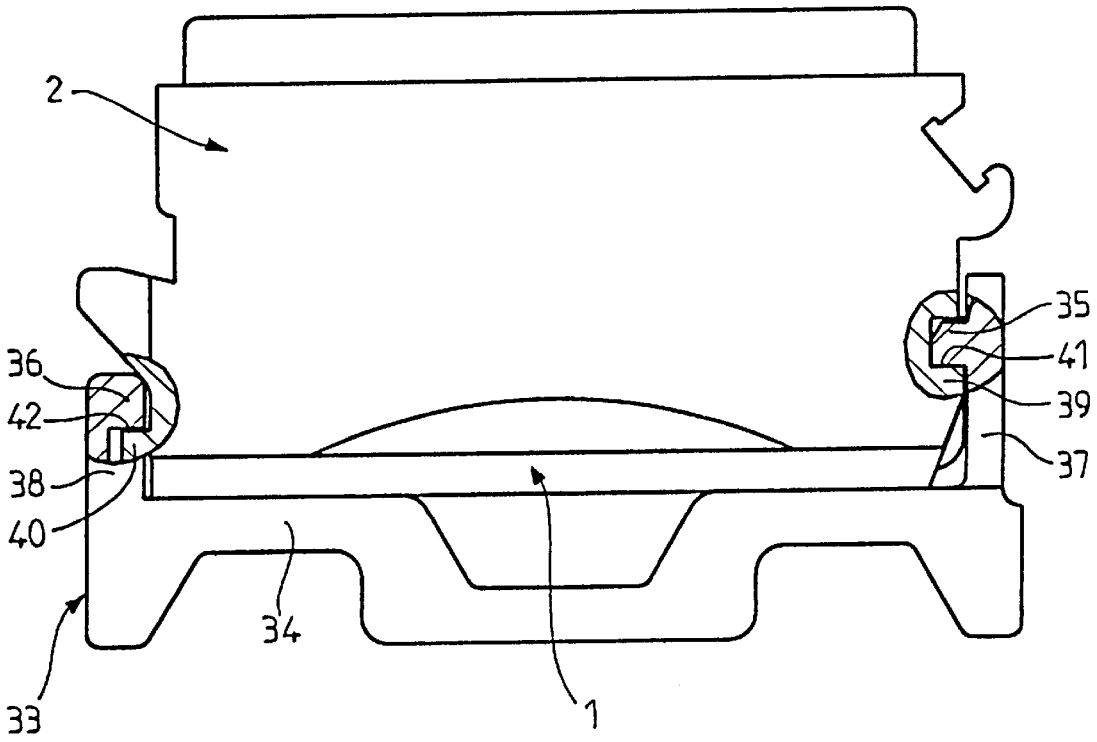
FIG. 10 hows diagrammatically a module according to the invention, fixed to a support rail which locks the two casing parts in the second position, as in FIGS. 2 and 5.

Finally, it should be pointed out that the module as shown in the drawings is a module intended to be fixed, as illustrated in FIG. 10, to a support rail 33 having a U-shaped profile, the module being held between the bottom 34 of the rail 33 and internal rims 35, 36 of the two flanges 37, 38 of the rail 33. Each tab 21, 22 of the upper casing part of the module includes, for this purpose, an external heel 39, 40 delimited upwards by a shoulder 41, 42, and the lower casing part includes, on its side walls 6, 7, beneath the shoulders 25, 26, external protuberances 43, 44 which, when engaged with the rims 23, 24 of the tabs 21, 22, define a first fitting position of the two casing parts, as in FIGS. 1 and 4, and a second fitting position as in FIGS. 2 and 5.

Figure 2:
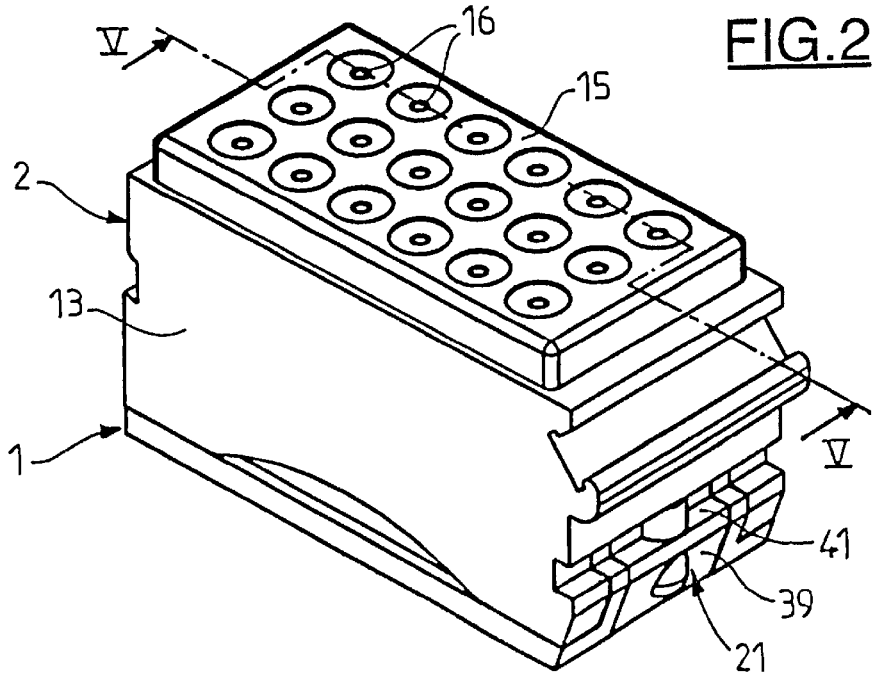
FIG. 2 is a view similar to FIG. 1, the two casing parts being in the second position.
Figure 3:
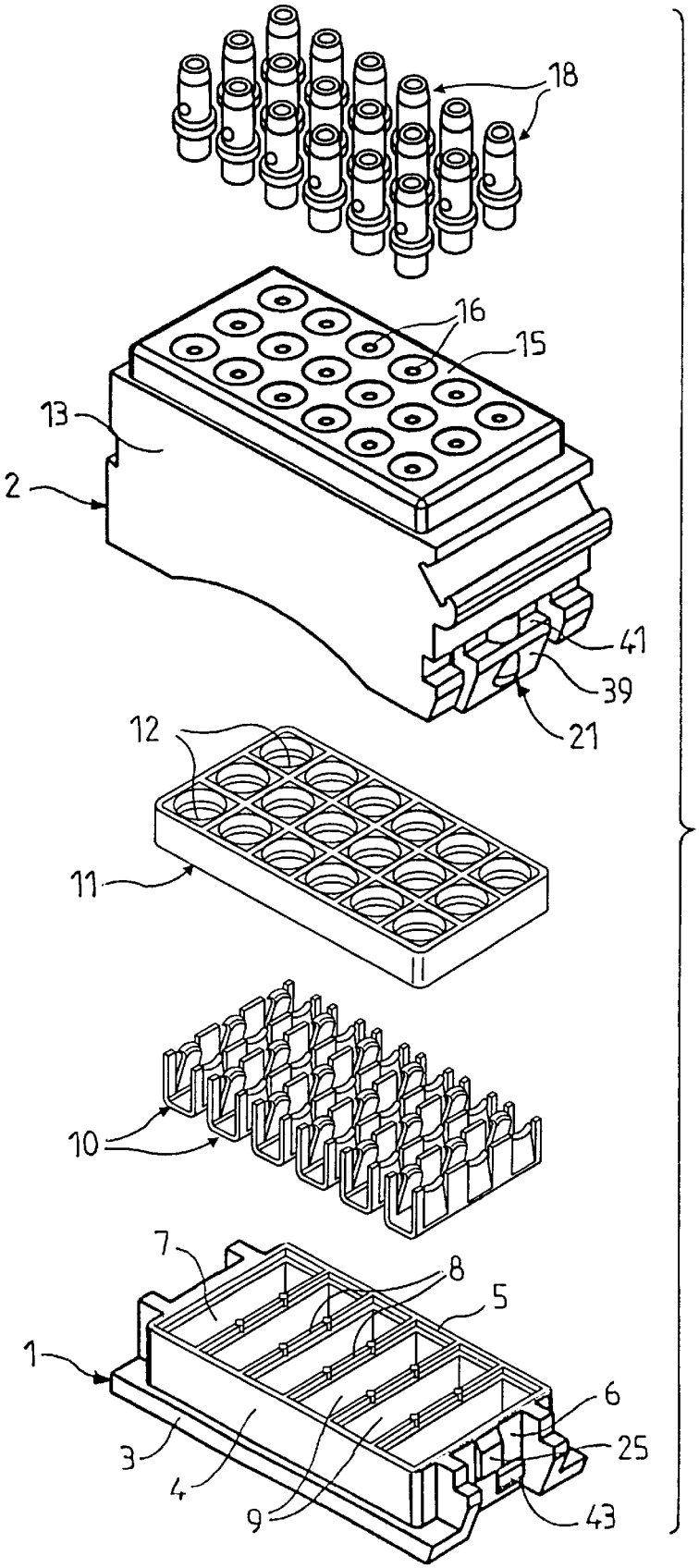
FIG. 3 is an exploded perspective view showing the pieces of which the module of FIGS. 1 and 2 is composed, as well as the contact terminals intended to be inserted into the module, without the conductors fixed to the terminals.

As may be seen in FIG. 10, the heights of the shoulders 41, 42 of the tabs 21, 22 of the upper casing part 2, with respect to the base, are matched to the heights of the internal rims 35, 36 of the flanges 37, 38 of the support rail 33, with respect to the base 34 of this rail, so that the module can be fixed to the rail, by engagement of the heels 39, 40 under the rims, only if the two casing parts 1, 2 occupy the second position as illustrated in FIGS. 2 and 5. In addition, when the module is fixed to the rail in this second reciprocal position of the two casing parts 1, 2, the rail locks the two casing parts in this second position as the heels 39, 40 are under the rims 35, 36 of the rail.

The method of operating the module according to the invention, as illustrated by the drawings, will be described below.

Firstly, while the two casing parts 1, 2 are in the first reciprocal position, as in FIGS. 1 and 4 (the "open" position), the contact terminals 18 of the conductors 17 to be interconnected are inserted through the holes 16 in the sealing part 15 into the cavities 14 of the casing part 2. This insertion may be performed without the use of a tool, simply by pressing on the conductor 17. Towards the end of this insertion movement, when the collars 20 of the terminals 18 reach the excrescences 29 of the snap-in fingers 27, the fingers 27 are splayed apart by the insertion force so that the collars 20 of the terminals 18 can get past the excrescences 29 and then be snapped in between the excrescences 29 and the internal stop rims 28 of the fingers 27. Due to this snap-in process, which is clearly perceptible to the operator, the terminals 18 are held in the position illustrated in FIGS. 4 and 6, in which position the terminals 18 are not plugged into, and are not in contact with, the shunts 10.

When all the terminals 18 have been inserted and snapped into the module in this way, the operator brings the two casing parts 1, 2 into the second position as in FIGS. 2 and 5, i.e. the deep fitting position (the "closed" position). During this movement of the two casing parts 1, 2 to the second position, the terminals 18 are plugged into the shunts 10. Simultaneously, the smaller-diameter portion 30 of the holes 12 in the insert 11 fits onto the fingers 27, as long as the latter are in the non-splayed position, that is to say that the collars 20 of the terminals 18 are snapped into position. This is because, if, due to incomplete insertion, one of the contact terminals 18 had not been snapped into position between the stop rims 28 and the snap-in excrescences 29 of the associated fingers 27, the fingers in question would prevent this plugging-in operation, and therefore would prevent the two casing parts from passing from the first position to the second position, thus indicating to the operator that one of the contact terminals had not been fully inserted.

After the two casing parts 1, 2 have passed into the second position, as in FIGS. 2 and 5, the insert 11 fastened to the body 3 of the lower casing part 1, and fitted onto the petals of the fingers 27 by the smaller-diameter portion of its through-holes 12, as may be seen in FIG. 7, reliably prevents any improper extraction of the contact terminals 18 from the shunts 10, by locking the fingers 27 in the position shown in FIG. 7.

Subsequently fitting the module onto a support rail 33, as in FIG. 10, ensures that the two casing parts 1, 2 are blocked, i.e. locked, in the second position, which locking can be undone only by disconnecting the module from its support rail.

In order to remove the contact terminals from the module, it is necessary firstly to undo the blocking or locking by the support rail 33 by removing the module from this rail, and then to unlock the snap-in fingers 27 and extract the contact terminals 18 from the shunts 10, by moving the casing 1, 2 from the second position, as in FIGS. 2 and 5, to the first position, as in FIGS. 1 and 4. After this unlocking step, the operator can remove the contact terminals 18, without the use of a tool, simply by exerting a pulling force on the conductors 17, this pulling force being sufficient for the collars 20 of the terminals 18 to be snapped out from the fingers 27.

The subject of the invention has been described above and illustrated by the appended drawings only with regard to its application, by way of indicative and non-limiting example, to a connection module, many modifications and alternative forms being possible within the context of the invention. Thus, the invention is also applicable to connectors composed of two parts, one having female contacts and the other male contacts, it being possible in this case for each connector part to comprise a casing made of two parts which can move, one with respect to the other, between two positions, as described previously. The two casing parts may, in this case, be locked in the second position by means other than a mounting rail for a connection module, for example by an accessory such as a cable tie fixed on the outside to one of the casing parts. In this case, the external subdivision of the casing into two parts passes via the region for fixing this accessory in such a way that the latter can be fixed only if the two casing parts occupy the second position and that, when the accessory is fixed, while the two casing parts are in the second position, the accessory locks the two parts of the casing in the second position. It is also conceivable, in the case of a connector, to lock the two casing- parts of one or each part of the connector in the second position by the means for blocking the two connector parts, one with respect to the other.

I claim:

1. An electrical connection device comprising:

an insulating casing consisting of first and second casing parts, said first casing part formed with a plurality of cavities, each said cavity adapted to receive a terminal having a retention arrangement formed with a retention collar extending outwardly from a body of the terminal and an end part, said second casing part having a plurality of contact elements and a locking arrangement, said first and second casing parts being movable with respect to one another and along axes of the cavities between first and second positions;

a snap-in arrangement situated at each said cavity of the first casing part, said snap-in arrangement in each said cavity containing a stop portion and a holding arrangement, said stop portion being adapted to engage the end part of the retention arrangement and to limit a depth of insertion of the terminals into the respective cavities;

said holding arrangement being adapted to engage opposite sides of the retention collar and to hold the terminals in a position inserted into said cavities; in said first position of the casing parts said snap-in arrangement engages the collar of the terminal so as to immobilize said contact terminals in a predetermined position, in said first position the terminals are disconnected from the contact elements and the locking arrangement disengages the snap-in arrangement; and in said second position the contact terminals being connected to the contact elements and the locking arrangement engages the snap-in arrangement for retention of the contact terminals.

2. The device according to claim 1, wherein said holding arrangement in said first position of the casing parts allows insertion of the terminals into the cavities and also allows extraction of the terminals from the cavities.

3. The device of claim 1, wherein said snap-in arrangement comprises at least two resilient fingers distributed about an axis of each said cavity.

4. The device according to claim 3, wherein the retention collar of each said contact terminal is formed with two portions situated substantially perpendicular to an axis of the contact terminal, said resilient fingers of the snap-in arrangement extend substantially in a direction of insertion of the contact terminals and said stop arrangement includes a rim directed substantially perpendicular to a free end of said fingers.

5. The device according to claim 1, wherein said snap-in arrangement is formed as a an integral portion of the first casing part.

6. The device according to claim 1, wherein said locking arrangement provided to lock the snap-in arrangement is an annular element provided for each terminal, said each annular element being situated within the second casing part , so that each said annular element does not engage the snap-in arrangement in the first position of said casing parts and fits into said snap-in arrangement in said second position of the casing part preventing the contact terminals from disengagement.

7. The device according to claim 1, wherein the retention arrangement of the terminals, the snap-in arrangement and the locking arrangement are formed in such a manner that the locking arrangement prevents said two casing parts from moving from said first position to said second position upon said resilient fingers of the snap-in arrangement being separated by the retention collar of each terminal when the terminals are not completely inserted into the corresponding cavities.

8. The device according to claim 1, wherein said snap-in arrangement retains said first and second casing parts in said first and second positions.

9. The device according to claim 1, wherein said device is formed as a connection module adapted for connection to a support rail having a U-shaped configuration with flanges provided with internal rims, said shoulders are arranged within the first casing part in such a manner that said shoulders engage the rims of the rail when said first and second casing parts are in the second position, the rail locks the casing parts in said second position when the module is attached to the rail.

10. The device of claim 1, wherein said device is formed as a connector with two connecting parts, one connecting part having a male contacts and another connecting part having female contacts and also including cable ties attached externally to at least one connecting part.

11. An electrical connection device comprising:

an insulating casing consisting of first and second casing parts, said first casing part formed with a plurality of cavities each said cavity adapted to receive a terminal having a retention arrangement formed with a retention collar extending outwardly from a body of the terminal and an end part, said second casing part having a plurality of contact elements and a locking arrangement, said first and second casing parts being movable with respect to one another and along axes of the cavities between first and second positions;

a snap-in arrangement situated at each said cavity of the first casing part, said snap-in arrangement in each said cavity containing a stop portion and a holding arrangement, said stop portion adapted to engage the end part of the retention arrangement and to limit the depth of insertion of the terminals into the respective cavities;

said holding arrangement being adapted to engage opposite sides of the retention collar and to hold the terminals in a position inserted into said cavities, in said first position of the casing parts said snap-in arrangement engages the collar of the terminals so as to immobilize said contact terminals in a predetermined position, said holding arrangement in said first position of the casing parts allows insertion of the terminals into the cavities and allows extraction of the terminals from the cavities;

whereby in said first position of the casing parts said terminals disengaging the contact elements and the locking arrangement disengaging the snap-in arrangement, and in said second position of the casing elements the contact terminals engage the contact elements and the locking arrangement engages the snap-in arrangement so as to lock the snap-in arrangement for retention of the contact terminals.

12. The device of claim 11, wherein said snap-in arrangement comprises at least two resilient fingers distributed about an axis of each said cavity.

13. The device according to claim 11, wherein the retention collar of each said contact terminal is formed with two portions situated substantially perpendicular to an axis of the contact terminal, said resilient fingers of the snap-in arrangement extend substantially in a direction of insertion of the contact terminals and said stop arrangement includes a rim directed substantially perpendicular to a free end of said fingers.

14. The device according to claim 11, wherein said snap-in arrangement is formed as a an integral portion of the first casing part.

15. The device according to claim 11, wherein said locking arrangement provided to lock the snap-in arrangement is an annular element provided for each terminal, said each annular element being situated within the second casing part , so that each said annular element does not engage the snap-in arrangement in the first position of said casing parts and fits into said snap-in arrangement in said second position of the casing part preventing the contact terminals from disengagement.

16. The device according to claim 11, wherein the retention arrangement of the terminals, the snap-in arrangement and the locking arrangement are formed in such a manner that the locking arrangement prevents said two casing parts from moving from said first position to said second position upon said resilient fingers of the snap-in arrangement being separated by the retention collar of each terminal when the terminals are not completely inserted into the corresponding cavities.

17. The device according to claim 11, wherein said snap-in arrangement retains said first and second casing parts in said first and second positions.

* * * * *